United States Patent [19]

Hudson et al.

[11] Patent Number: 4,739,705

[45] Date of Patent: Apr. 26, 1988

[54] ARMING AND MOTOR IGNITION DEVICE

[75] Inventors: James Hudson; Alan W. Holt, both of Hertfordshire, England

[73] Assignee: British Aerospace PLC, London, England

[21] Appl. No.: 924,483

[22] Filed: Oct. 29, 1986

[30] Foreign Application Priority Data

Oct. 29, 1985 [GB] United Kingdom ..... 8526599

[51] Int. Cl.[4] ..... F42B 15/10; F42C 15/34

[52] U.S. Cl. ..... 102/222; 102/206; 102/216; 102/249; 102/255; 102/379

[58] Field of Search ..... 102/221, 222, 200, 206, 102/379, 247, 248, 249, 251, 254, 255, 256

[56] References Cited

U.S. PATENT DOCUMENTS

| | | | |
|---|---|---|---|
| 2,889,777 | 6/1959 | Rabinow | 102/216 |
| 3,181,466 | 5/1965 | Czajkowski | 102/206 |
| 3,750,583 | 8/1973 | White et al. | 102/221 |
| 4,337,701 | 7/1982 | Janson | 102/249 |
| 4,372,212 | 2/1983 | Hoelzen et al. | 102/379 X |

*Primary Examiner*—David H. Brown

*Attorney, Agent, or Firm*—Cushman, Darby & Cushman

[57] ABSTRACT

A combined warhead arming and drive motor ignition device for a self-propelled missile having a warhead and a drive motor comprises a first acceleration responsive means (1, 2, 3, 4) to provide an output when the missile achieves a first acceleration, a timer initiated by the output from the first acceleration responsive means and providing a first output (i) after expiry of a first period and before expiry of a second period and a second output (v) after expiry of a third period, and a speed responsive means (5, 6) to provide a speed output (ii) when the missile has attained a predetermined speed and also to provide a first distance indication output (vi) when the missile has travelled a first distance but has not yet travelled a second distance and a second distance indication (vi) output when the missile has travelled a third distance. The device also includes gating means to provide an output in response to the receipt of all of the first output (i) from the timer, the speed output (ii) and the first distance indication output of the speed responsive means, ignition means to ignite the drive motor in response to the output of the gating means, and second acceleration responsive means (12, 13) which are enabled by the second output (vi) of the timing means and by the second distance indication output (vi) of the speed responsive means and which, when subjected to a predetermined acceleration consistent with successful ignition of the drive motor, enables arming and firing of the warhead.

12 Claims, 1 Drawing Sheet

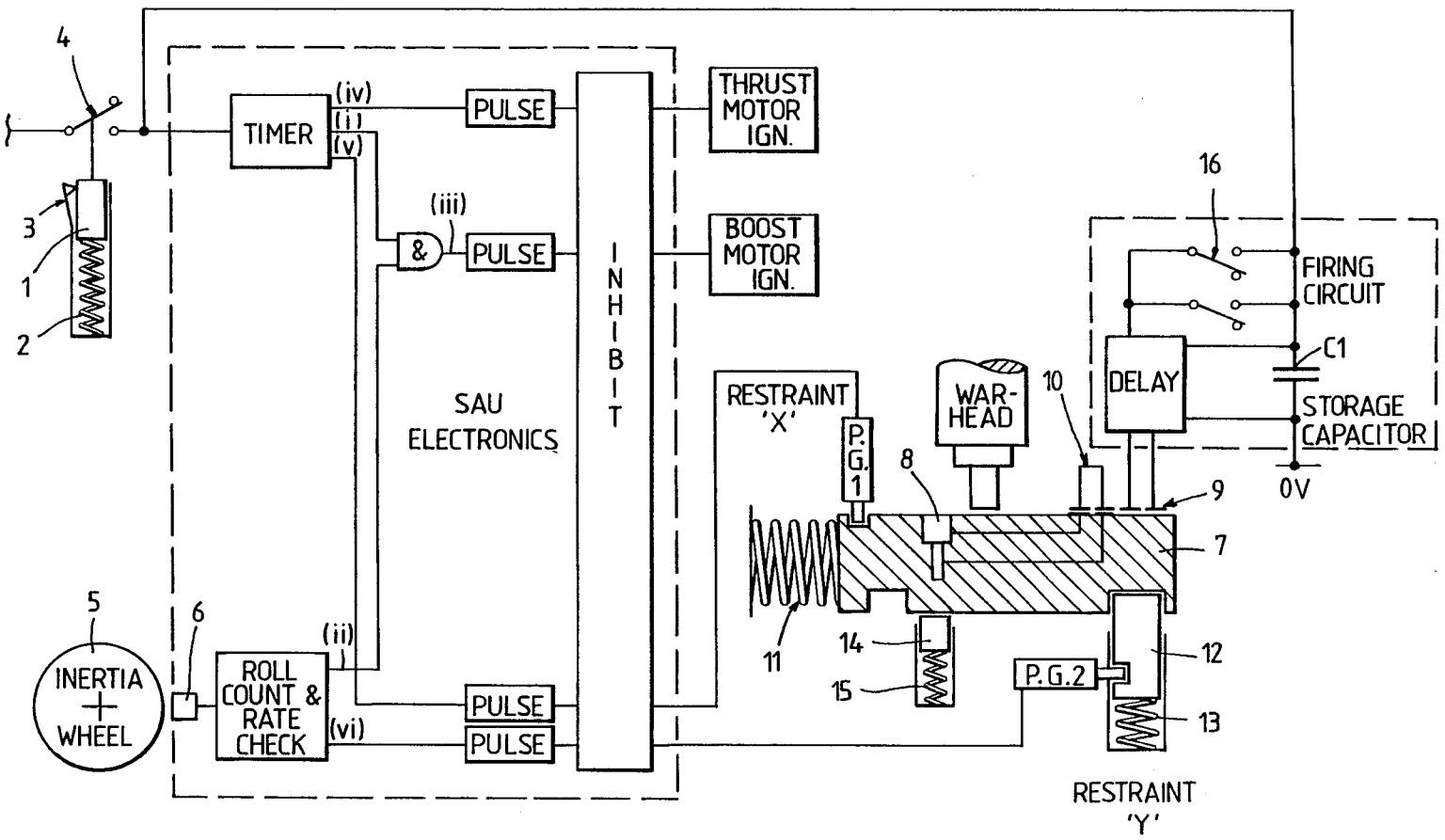
FIRING CIRCUIT
C1
STORAGE CAPACITOR
0V
16
DELAY
9
7
12
13
RESTRAINT 'Y'
10
P.G.2
WAR-HEAD
8
14
15
P.G.1
RESTRAINT 'X'
11
THRUST MOTOR IGN.
BOOST MOTOR IGN.
I N H I B I T
PULSE
PULSE
SAU ELECTRONICS
PULSE
PULSE
(iii)
&
(iv)
(i)
(v)
(ii)
(vi)
TIMER
ROLL COUNT & RATE CHECK
6
5
INERTIA + WHEEL
4
3
1
2

ARMING AND MOTOR IGNITION DEVICE

This invention relates to self-propelled missiles including a warhead and a drive motor and, in particular, relates to devices for igniting the drive motor and arming the warhead of such missiles.

A missile is usually ejected from a housing or support by an expulsion motor and it is desirable to ignite the drive motor for the missile after it has moved a predetermined distance away from its housing or support and before too long has elapsed from initial ejection that an unsuccessful flight is likely to result. It is also desirable not to arm the warhead contained in the missile until the drive motor of the missile has been successfully ignited. Existing systems for achieving this are largely mechanical and tend to be reasonably complicated with a possibility of unreliability in operation.

According to this invention a combined warhead arming and drive motor ignition device for a self-propelled missile having a warhead and a drive motor comprises a first acceleration responsive means to provide an output when the missile achieves a first acceleration, a timer initiated by the output from the first acceleration responsive means and providing a first output after expiry of a first period and before expiry of a second period and a second output after expiry of a third period, a speed responsive means to provide a speed output when the missile has attained a predetermined speed and also to provide a first distance indication output when the missile has travelled a first distance but has not yet travelled a second distance and a second distance indication output when the missile has travelled a third distance, gating means providing an output in response to the receipt of all of the first output from the timer, the speed output and the first distance indication output of the speed responsive means, ignition means to ignite the drive motor in response to the output of the gating means, and second acceleration responsive means which are enabled by the second output of the timing means and by the second distance indication output of the speed responsive means and which, when subjected to a predetermined acceleration consistent with successful ignition of the drive motor, enables arming and firing of the warhead.

With the arrangement in accordance with this invention the first thing that is checked is that the missile is subjected to an initial, predetermined, degree of acceleration by the expulsion motor and, once this has been detected by the first acceleration responsive means a check is then made to ensure that the missile has travelled a predetermined distance and attained a predetermined speed within a predetermined time window. Only if all of these conditions are met is the drive motor then ignited. The device then goes on to monitor the distance travelled and speed of the missile and also monitors the occurence of a further time period. Occurrence of all of these enables the second acceleration responsive means to respond to the acceleration occuring at that point and, if this is sufficient to indicate that the drive motor of the missile has been fired successfully then, but only then, is the warhead of the missile armed.

The non-occurrence of any one of these events in the sequence, or the occurrence of any one at the incorrect time inhibits the further operation of the device. This inhibits the arming of the warhead and, if the fault occurs early enough, inhibits the firing of the drive motor of the missile.

Preferably the drive motor of the missile includes an initial boost motor and a separate thrust motor. In this case the output from the gating means preferably ignites the boost motor and the timer preferably provides a third output after the expiry of a fourth time period. In this case the third output of the timer ignites the thrust motor.

Preferably the arming device includes a spring biased shuttle carrying a detonator for the warhead and held into a first position in which the detonator is not aligned with the stem of the warhead by releaseable detent means. Upon release of the detent means the shuttle is moved by its bias spring into its second position in which the detonator is aligned with the stem of the warhead so arming the warhead. Preferably a latch is provided to lock the shuttle into its second position.

The detent means preferably include a piston gas motor which normally locks the shuttle into its first position but which is actuable by the second output of the timer to release the shuttle. Preferably the detent means also includes a spring biased mass in engagement with a recess in the shuttle and responsive to the predetermined acceleration of the missile caused by ignition of its drive to move out of the recess of the shuttle. In this case the spring biased weight provides the second acceleration responsive means, and another device such as a piston gas motor is associated with the mass to prevent its movement away from the shuttle until the second piston gas motor has received the second output from the speed responsive means.

The detonator may be a mechanical stab sensitive detonator or a stab sensitive ignitor in series with a flash sensitive detonator but preferably it includes an electronic firing circuit which is only enabled by the output from the first acceleration responsive means. In this case the firing circuit preferably includes a storage capacitor, a delay circuit and one or more switches to trigger the delay circuit and electrically fire the detonator. In this case the electrical leads from the detonator are preferably short circuited when the shuttle is in its first position but are connected to the firing circuit when the shuttle is in its second position. The firing switches of the firing circuit may be formed by crash switches, break switches, piezo electric sensors or accelerometers but preferably they are formed by simple inertia switches. Instead of an electronic delay circuit to delay the application of the current from the storage capacitor to the detonator the warhead may include a built-in explosive delay either when it is detonated by a mechanical detonator or when detonated by an electrically triggered detonator.

The first acceleration responsive means is preferably an electromechanical device in which a spring biased mass operates an electrical switch to close a pair of electrical contacts when subjected to an acceleration equal to a predetermined value and, in this case, the device preferably includes a latch which, thereafter, holds the contacts in the closed position. In this case it is preferred that the power supply for the entire device is taken through the contacts of this switch. Alternatively however both the first and second acceleration responsive means may include accelerometers to sense and measure both the launch acceleration and drive motor acceleration.

Preferably the speed responsive means includes an inertia wheel mounted for rotation on the longitudinal axis of the missile, or a gyroscope which may already be present as part of an inertial guidance system and means to monitor rotation of the missile relative to the inertia wheel or gyroscope. In practice, the missile is caused to roll for stability and as it moves, the rate of revolution gives an indication of the speed of the missile at any particular instant, with the number of revolutions giving an indication of the total distance travelled by the missile. The revolutions of the missile relative to the inertia wheel or gyroscope may be monitored by a Hall effect device located adjacent the inertia wheel and a magnetic inertia wheel or may be monitored by optical sensors located adjacent the inertia wheel or gyroscope which interact with a reflector mounted on or an aperture through the inertia wheel or gyroscope. The sensor associated with the inertia wheel is preferably associated with a circuit which includes means to count the number of revolutions of the wheel or gyroscope and so provide an indication of the distance travelled by the missile and means to produce an indication of the rate at which the revolutions are occurring and hence the speed at which the missile is travelling.

A particular example of a device in accordance with this invention will now be described with reference to the accompanying drawing which is a generalised block diagram.

The device includes a launch acceleration sensor comprising a mass 1, a spring 2, a latch 3 and electrical contacts 4; a roll sensor including a magnetic inertia wheel 5 and Hall effect sensor 6; an arming mechanism including a movable shuttle 7 and a detonator 8; and, a firing circuit.

The arming mechanism includes contacts 9 from the firing circuit, a shorting link 10, a spring 11 biassing the shuttle 7 into a second position and restraints X and Y which hold the shuttle in the first position. Restraint X is formed by a piston gas motor PG1 actuating a pin which is normally received in a recess in the shuttle 7 to lock the shuttle 7 into its first position. However, upon actuation of the piston gas motor the pin moves away from the shuttle 7. Restraint Y comprises a mass 12 which is arranged axially of the missile and biased in the forwards direction by a spring 13. The mass 12 includes a recess in which is located a pin of a second piston gas motor PG2. The second piston gas motor PG2 normally holds the mass 12 into its recess in the shuttle 7. However, actuation of the second piston gas motor PG2 moves the pin away from the mass 12 and hence, when subjected to sufficient acceleration, the mass 12 is able to compress the spring 13 and so move out of the shuttle 7, thereby releasing the shuttle 7.

When both the restraint X and the restraint Y have been released the spring 11 urges the shuttle 7 into its second position, that is to the right as shown in the Figure and so aligns the detonator 8 with the stem of the warhead and connects the electrical contacts of the detonator 8 across the contacts 9 of the firing circuit. A latch formed by a pin 14 and spring 15 engages in a recess in the body of the shuttle 7 to lock the shuttle 7 into its second position.

The firing circuit is provided with power from a line connected to the switch contacts 4 so that power from the battery associated with the missile is connected to a storage capacitor C1 forming part of the firing circuit. The storage capacitor C1 is connected in parallel with a delay circuit and the input to the delay circuit is connected to a pair of inertia switches 16 having a mutually orthogonal orientation. Once the delay caused by the delay circuit has expired the storage capacitor C1 is connected across the terminals 9 and, in use, across the detonator 8 to fire the detonator 8 and hence the warhead.

During launch of the missile by the expulsion motor, provided that the level of acceleration exceeds a predetermined minimum figure the spring 2 is compressed by the rearwards movement of the mass 1 which allows the mass 1 to close the contacts 4. The mass 1, and therefore the contacts 4 are then held in this position by the latch 3. Closure of the contacts 4 applies power from the missile battery to the electronics of the safety arming unit (SAU) and to the firing circuit initiating the build-up of charge in the storage capacitor C1.

When battery power is applied to the SAU electronics two separate circuits are energised. A first circuit contains a timer which produces an output i when the time equivalent to a minimum safe separation distance of 20 meters has elapsed. Naturally this time equivalent is the minimum time by which the missile would normally have reached a distance of 20 meters. The second circuit contains the Hall sensor 6 which produces a pulse signal as the missile rolls around its inertia wheel 5. Provided that the pulses are generated at a rate indicating the correct roll rate, and hence the correct linear velocity of the missile and, that a number of pulses equivalent to a distance of 20 meters have been generated the second circuit produces a signal ii. The outputs from the two circuits are routed via an AND gate and the resulting signal iii applies a pulse of battery power to a boost motor ignitor. A pulse is used instead of a continuous supply to prevent battery drain caused by a short circuit in the fired ignitor.

Two hundred milliseconds after pulse iii has been passed to the boost motor ignitor pulse iv is routed to a thrust motor ignitor to ignite the main thrust motor of the missile.

If the output from the i or ii from either circuit has not been received at the AND gate when the output from the timer indicates the missile should have travelled 30 meters or the output from the sensor 6 indicates that the missile has travelled a distance beyond 30 meters, the inhibit function operates to prevent triggering of the boost motor and, hence of the thrust motor. If the missile has travelled a distance beyond 30 meters or a sufficient time has elapsed to allow the missile to travel a distance beyond 30 meters without having travelled this distance it is unlikely that a successful flight of the missile is now possible and accordingly the main drive motor of the missile is never ignited nor the warhead of the missile ever armed.

Assuming that the AND gate does provide a pulse to trigger the boost motor ignition and hence the thrust motor ignition then the timer produces a further output v when the time equivalent to the minimum safe arming distance for the warhead of 50 meters has elapsed. This output is used to apply a pulse of battery power to the piston gas motor forming part of the restraint X thus removing the restraint X from the shuttle 7. The second circuit associated with the Hall effect sensor 6 produces an output vi when a number of rolls of a missile equivalent to 50 meters have been counted and have occurred at the correct rate to indicate that the missile is flying at the correct speed. This output is used to apply a pulse of battery power to the second piston gas motor PG2 forming part of the restraint Y.

The restraint Y is now free to move and, provided that sufficient acceleration is being imparted to the missile by the boost motor, the spring 13 is compressed by the mass 12 to enable the mass 12 to disengage from the shuttle 7. The shuttle 7 is then moved by the spring 11 into its second position and moves from its SAFE position to the ARMED position. This shuttle movement results in the detonator 8 being aligned with the warhead stemming and, at the same time, disconnects the safety shorting link 10 from the detonator wires and connects the detonator to the firing circuit via the contacts 9. The shuttle is locked in the armed position by the pin 14 driven by the spring 15.

When the missile impacts against the target the shock is sufficiently high momentarily to close either or both the inertia switches 16 and the delay circuit is energised. When a delay time of 600 μs has elapsed it is assumed that the warhead has passed through the skin of a target and then, energy from the storage capacitor C1 is routed to the detonator 8 thus initiating the warhead explosive train. Since the capacitor C1 is charged from the missile battery during the launch and flight of the missile this ensures that the warhead detonates even if the battery does not survive the impact of a missile with the target.

Thus if any of the performance requirements such as the launch acceleration, the roll rate and the distance travelled in the missile are not satisfied at various times during the launch of the missile, the boost and thrust motors are not ignited and the warhead is not armed and thus does not detonate on impact. In addition, even if the requirements for boost motor ignition are met but the motor fails to ignite and perform with a satisfactory degree of acceleration then the warhead is still not armed as the shuttle restraint Y holds the shuttle in its SAFE position.

We claim:

1. A combined warhead arming and drive motor ignition device for a self-propelled missile having a warhead and a drive motor comprising:

first acceleration responsive means for determining when the missile achieves a first acceleration and producing an output signal indicative thereof;

a timer, initiated by said output signal from the first acceleration responsive means, for providing a first output signal after expiration of a first period and before expiration of a second period, and providing a second output signal after expiration of a third period;

speed responsive means for providing a speed output signal when the missile has attained a predetermined speed and also for producing a first distance indication output signal when the missile has travelled a first distance but has not yet travelled a second distance, and producing a second distance indication output signal when the missile has travelled a third distance;

gating means for providing an output signal in response to the receipt of all of (a) the first output signal from the timer, (b) the speed output signal and (c) the first distance indication output signal from the speed responsive means;

ignition means for causing an ignition of the drive motor in response to the output signal of the gating means; and second acceleration responsive means, enabled by the second output signal of the timing means and by the second distance indication output signal of the speed responsive means, for enabling arming and firing of the warhead when subjected to a predetermined acceleration consistent with successful ignition of the drive motor.

2. A device as in claim 1, further comprising a missile.

3. A device as in claim 1, wherein all of said output signals are electrical signals.

4. A device according to claim 1, in which the drive motor of the missile includes an initial boost motor and a separate thrust motor, and wherein the output signal from the gating means ignites the boost motor, and wherein the timer provides a third output signal after the expiration of a fourth time period, the third output signal of the timer igniting the thrust motor.

5. A device according to claim 4, further comprising a spring biased shuttle carrying a detonator for the warhead including detent means, for holding said detonator in a first position in which the detonator is not aligned with the stem of the warhead, said detent means releasable by the second output signal of the timer, to enable the shuttle to be moved by its bias spring into its second position in which the detonator is aligned with the stem of the warhead, so arming the warhead.

6. A device according to claim 5, further comprising a latch to lock the shuttle into its second position.

7. A device according to claim 5, in which the detent means includes a piston gas motor which normally locks the shuttle into its first position but which is actuable by the second output of the timer to release the shuttle.

8. A device according to claim 5, in which the second acceleration responsive means comprises a spring biased mass in engagement with a recess in the shuttle and responsive to a predetermined acceleration of the missile caused by ignition of said drive means to move the mass out of the recess of the shuttle, and means, associated with the mass for preventing a movement of said mass away from the shuttle until said preventing means has received the second output signal from the speed responsive means.

9. A device according to claim 5, further comprising an electronic firing circuit having a storage capacitor, a delay circuit and one or more switches to trigger the delay circuit and electrically fire the detonator, and in which electrical leads from the detonator are short circuited when the shuttle is in its first position and connected to the firing circuit when the shuttle is in its second position.

10. A device according to claim 5, in which the first acceleration responsive means is an electromechanical device in which a spring biased mass operates an electrical switch to close a pair of electrical contacts when subjected to an acceleration equal to the first acceleration and which includes a latch to hold the contacts in their closed position.

11. A device according to claim 10, wherein said electromechanical device comprises contact means for receiving the power supply for the entire device.

12. A device according to claim 5, in which the speed responsive means includes an inertia wheel mounted for rotation on a longitudinal axis of the missile and means to monitor rotation of the missile relative to the inertia wheel.

* * * * *